US006637485B1

(12) United States Patent
Sartena

(10) Patent No.: US 6,637,485 B1
(45) Date of Patent: Oct. 28, 2003

(54) HANDBAG OR THE LIKE WITH COVERED, TRANSPARENT WALL

(76) Inventor: Stacey Eve Sartena, 75 Edgewood Ave., Smithtown, NY (US) 11787

( * ) Notice: Subject to any disclaimer, the term of this patent is extended or adjusted under 35 U.S.C. 154(b) by 0 days.

(21) Appl. No.: 10/336,932

(22) Filed: Jan. 6, 2003

(51) Int. Cl.[7] ..... A45C 3/00; A45C 3/06; A45C 13/10

(52) U.S. Cl. ..... 150/118; 150/101; 150/151; 150/152; 383/106

(58) Field of Search ..... 150/100–102, 150/106, 107, 112, 118, 151, 152; 190/902, 903; 383/72, 106

(56) References Cited

U.S. PATENT DOCUMENTS

| | | | | | |
|---|---|---|---|---|---|
| 244,722 | A | * | 7/1881 | Knittel | 150/152 |
| 597,325 | A | * | 1/1898 | Prockett | 150/151 |
| 2,603,266 | A | * | 7/1952 | Carroll | 150/118 |
| 2,723,696 | A | | 11/1955 | Kase | |
| 3,182,701 | A | | 5/1965 | Ginsburg | |
| 3,556,187 | A | | 1/1971 | Speakes | |
| 3,870,132 | A | * | 3/1975 | Hanley | 150/118 |
| 3,955,609 | A | | 5/1976 | Siegel | |
| 4,022,261 | A | * | 5/1977 | Russell | 150/100 X |
| 4,112,991 | A | | 9/1978 | Barbaresi | |
| 4,580,667 | A | | 4/1986 | Herwood | |
| 4,674,664 | A | * | 6/1987 | Simon | 383/72 X |
| 5,007,470 | A | | 4/1991 | Freeman | |
| 5,255,833 | A | * | 10/1993 | McAllister | 150/110 X |
| 5,533,558 | A | | 7/1996 | Carey et al. | |
| 5,725,039 | A | | 3/1998 | Macinai et al. | |
| 5,782,280 | A | * | 7/1998 | Berry | 150/112 |
| 5,829,657 | A | | 11/1998 | Romer, Jr. | |
| 6,206,567 | B1 | * | 3/2001 | Cyr | 190/903 X |
| 6,220,318 | B1 | | 4/2001 | Pinti | |
| 6,231,233 | B1 | | 5/2001 | Orce | |
| 6,237,660 | B1 | | 5/2001 | Giardino | |
| D447,335 | S | * | 9/2001 | Vazquez | D3/233 |
| 6,435,391 | B1 | * | 8/2002 | Vazquez | 383/72 X |

FOREIGN PATENT DOCUMENTS

| | | | | |
|---|---|---|---|---|
| CH | 562581 | * | 6/1975 | 150/112 |
| FR | 2406969 | * | 6/1979 | |
| FR | 2584910 | * | 1/1987 | |

* cited by examiner

*Primary Examiner*—Sue A. Weaver
(74) *Attorney, Agent, or Firm*—Schweitzer Cornman Gross & Bondell LLP

(57) ABSTRACT

An improved handbag or the like having one entire side wall formed of a transparent panel which can be selectively exposed to permit facilitated viewing of items contained therein. The transparent panel is joined to an opaque panel to form a receptacle with an access opening at the top. An exterior cover panel is removably positioned in covering relation to the transparent panel and at least partially separably attached to the bag structure, allowing the cover panel to be displaced from covering relation to enable facilitated viewing of personal affects through the transparent panel for easy selection and removal.

14 Claims, 5 Drawing Sheets

HANDBAG OR THE LIKE WITH COVERED, TRANSPARENT WALL

FIELD OF THE INVENTION

The present invention pertains generally to handbags and the like and more particularly, to an improved carrying bag enabling facilitated viewing and retrieval of stored contents.

BACKGROUND OF THE INVENTION

Handbags and the like, which include central openings at the uppermost portion of the bag, are commonly used to carry a plethora of personal articles including cosmetics, keys, paper and coin money, bankbooks, etc. These items are often placed loosely in carrying bags among a variety of other articles and thereby, difficult to locate through the opening of the bag, especially when the user is hurriedly reaching for a particular item therein.

A variety of carrying bags have been devised to promote retrieval of stowed items. Certain of such handbags contain compartments, or pockets, designed to hold numerous individual items. Handbags of this type range from those having a few to a multitude of storage compartments for organized placement of a user's personal affects. While such compartments facilitate organization of items carried within a handbag, an organizational system only facilitates retrieval of items when personal items are actually placed within the provided compartments and when a user remembers where such items are stored. It is well known, however, that since handbags, or other such carrying bags are carried by women at virtually all times, the temptation to indiscriminately toss items in a handbag or the like is often hard to resist. Consequently, compartmentalized carrying bags are not often used in the intended manner, so personal affects remain difficult to see and retrieve, buried within the main storage receptacle.

Accordingly, the primary object of the present invention is to provide a dual function handbag or the like which, while being conventional in appearance and being usable in a conventional manner, also incorporates unique features to facilitate direct viewing and retrieval of items contained within a handbag or the like, permitting effortless access to contained items even in the absence of compartmentalized organization.

A further object of the present invention is to provide a handbag or the like that can be manufactured in a variety of configurations and designs with conventional appearance and function, while still incorporating special features to allow items to be readily viewed and retrieved therefrom.

Another object of the present invention is to enable users to move more quickly through security checkpoints by providing a handbag or the like of improved design, which permits rapid and trouble-free viewing by security personnel.

Yet another object of the present invention is to provide a safe storage area for users, wherein items can be viewed prior to and during retrieval, thereby reducing the potential for a user's hand to be punctured by sharp objects such as nail files, scissors and writing implements.

SUMMARY OF THE INVENTION

The foregoing objects are met by the present invention which is directed to a handbag or the like having a transparent interior panel which can be selectively exposed to permit facilitated viewing of items contained therein.

Broadly described, the invention includes a bag structure comprised of a first panel connected to a second panel along the bottom and sides and forming a receptacle having a convenient access opening at the top. In accordance with the invention, one of the panels is formed of a flexible transparent material, through which visual access is realized.

In a preferred form, the handbag or the like includes a cover panel dimensioned to extend over the transparent panel, allowing the user to conceal personal affects contained within the bag structure. The cover panel is removably positioned in covering relation to the transparent panel, and at least partially separably attached to the bag structure, so that the cover panel may be easily displaced to view the contents of the bag. Fastening means are employed to releasably secure the cover panel in a "closed" position, to conceal the interior of the bag yet permit displacement thereof for viewing the contents of the bag through the transparent panel when desired.

In accordance with the present invention, the cover panel is movable relative to the bag structure between a first position, in which the cover panel is positioned in covering relation to the transparent first panel, and a second position, in which the cover panel is displaced from covering relation to enable facilitated viewing of the bag contents through the transparent panel. Accordingly, the invention allows a user to conveniently displace the cover of the bag to find a desired item amongst a plethora of items loosely contained therein.

According to a further aspect of this invention, the handbag or the like may be manufactured in a variety of styles and designs, including a rounded or straightedged conventional purse structure, a knapsack, backpack, briefcase, etc., which is comprised of one or more flexible transparent walls forming the main receptacle of the bag, and removable cover panel or panels associated therewith which, when closed, give the bag a conventional appearance and function. When opened the cover panel(s) provide direct visual access to the entire contents of the bag and also easier physical access to such contents. In addition to providing features which are more convenient and useful to the user, the bag is useful in environments of increased security such as sports arenas, airports, museums and the like wherein bags are customarily searched. The transparent wall panel allows security personnel to quickly visually inspect the entire contents of a user's handbag without inserting their hands therein.

DESCRIPTION OF DRAWINGS

The above and other objects, features and advantages of the present invention will become apparent from the following description of preferred, but nonetheless, illustrative embodiments of the invention, taken in conjunction with the accompanying drawings, wherein.

DETAILED DESCRIPTION OF THE PREFERRED EMBODIMENTS

Figure 1:
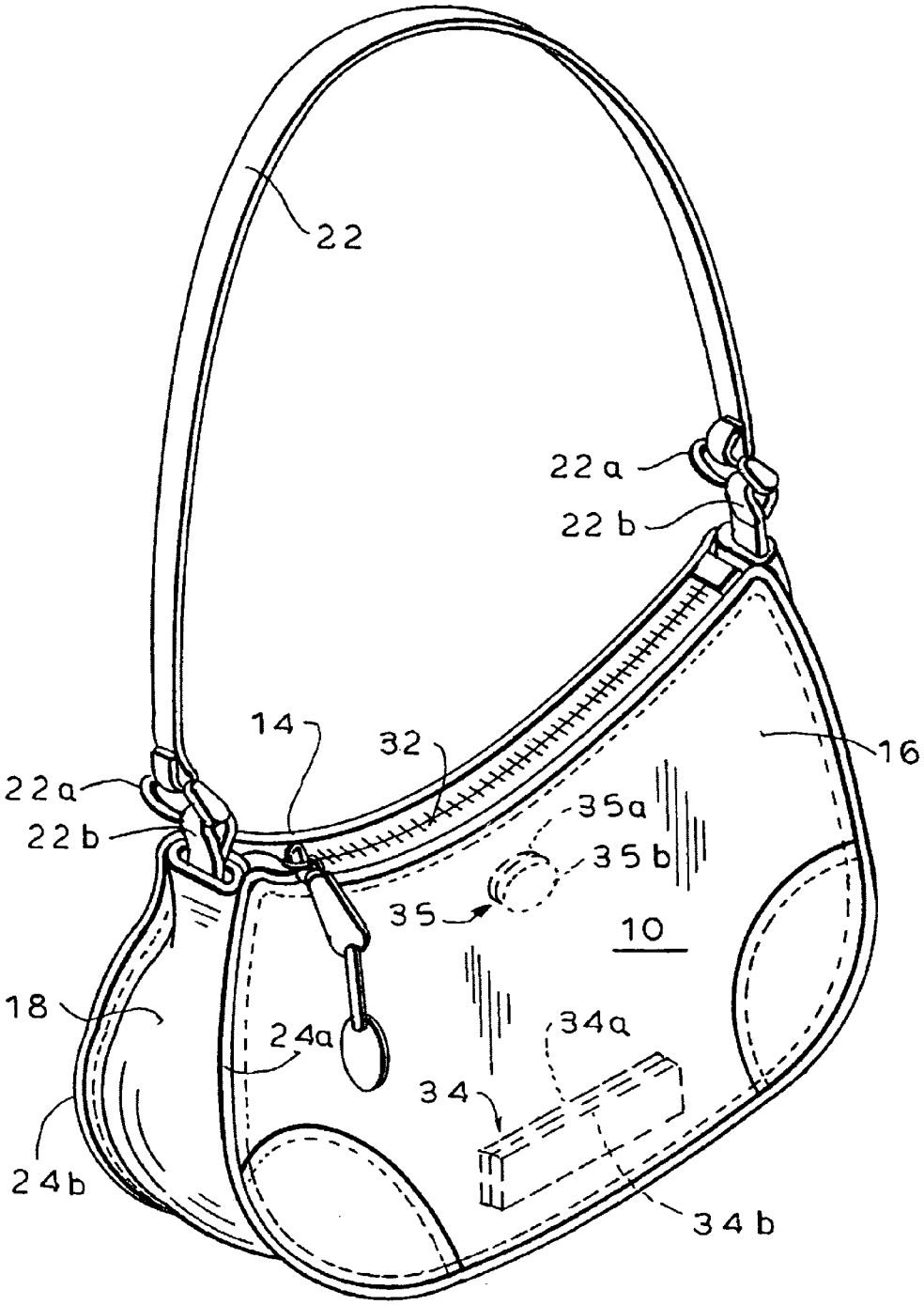
FIG. 1 is a perspective view of a dual function handbag in accordance with the invention.
Figure 2:
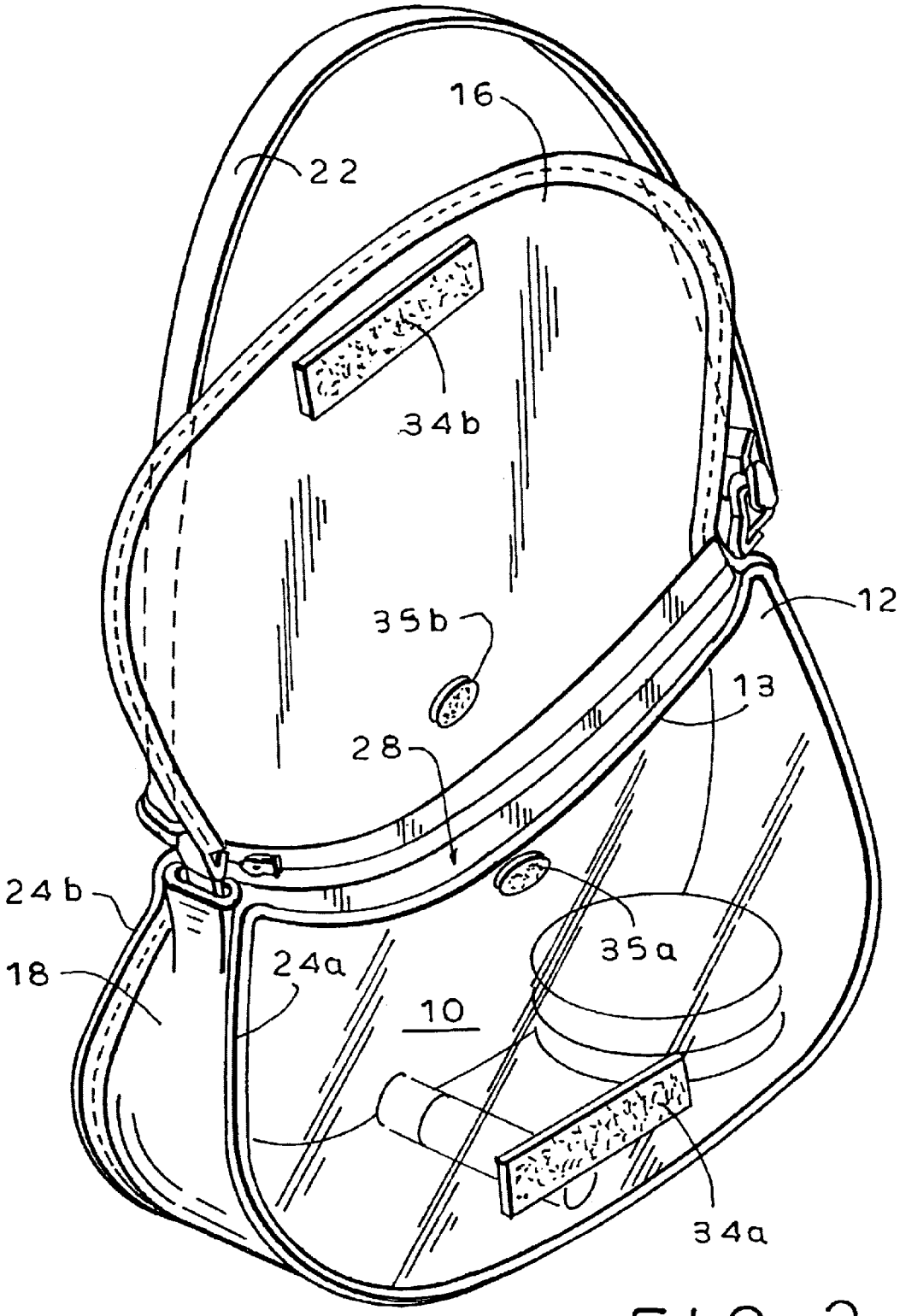
FIG. 2 is a perspective view of the handbag of FIG. 1 showing the cover panel in an open position, exposing the interior receptacle.
Figure 3:
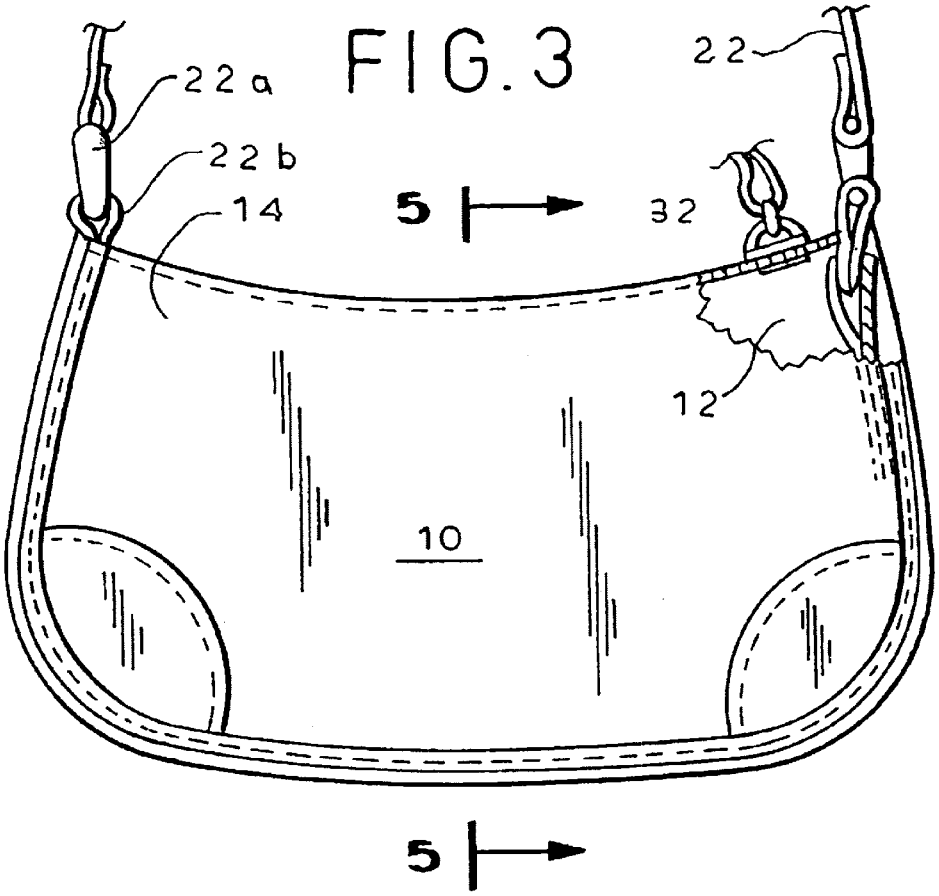
FIG. 3 is an elevational view of the rear side of the handbag of FIG. 1, a portion thereof being broken away to illustrate features of its construction.
Figure 4:
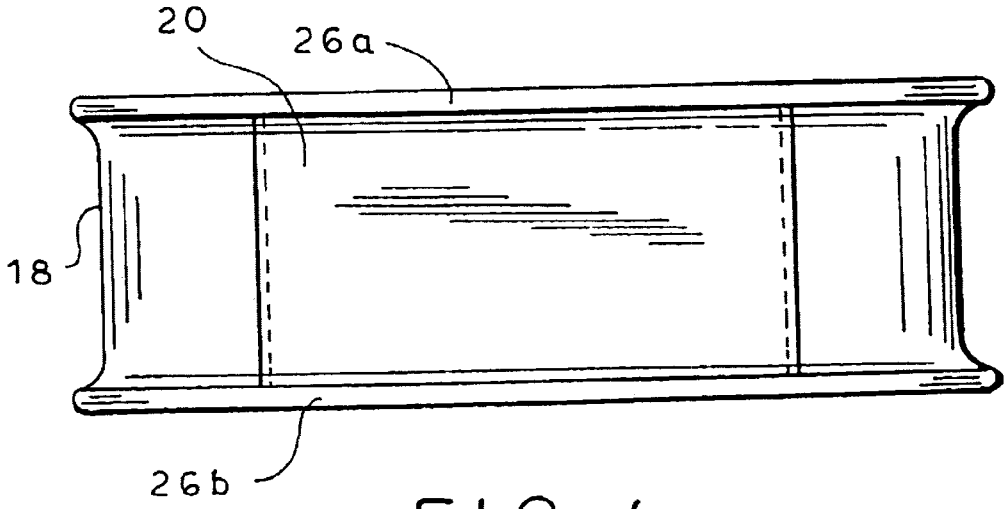
FIG. 4 is a bottom plan view of the handbag of FIG. 1.
Figure 5:
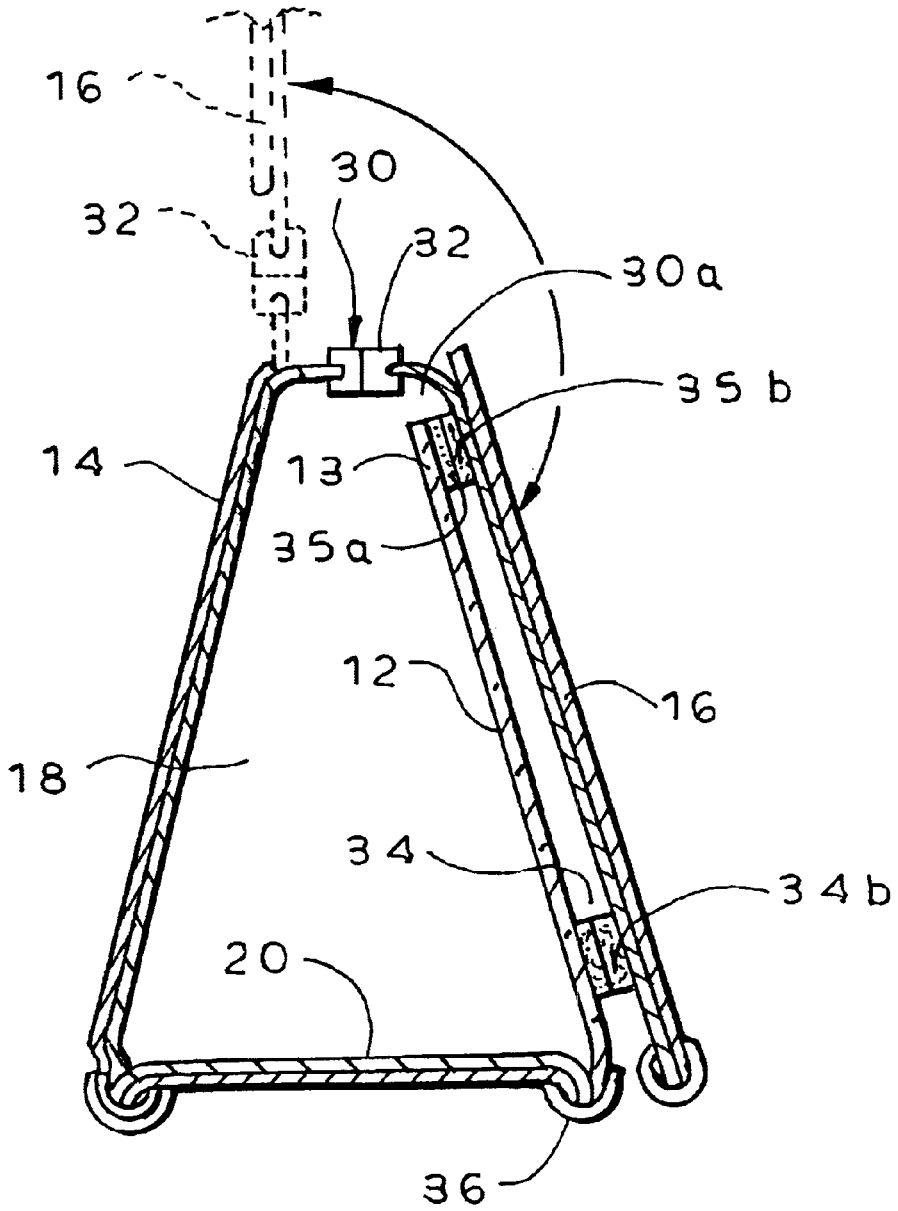
FIG. 5 is a cross sectional view as taken generally on line 5—5 of FIG. 3.

With particular reference to the drawings, and initially to FIGS. 1–5 thereof, the present invention is directed to an improved handbag or the like generally referenced by numeral 10. In accordance with certain aspects of the invention, the handbag structure 10 is shown comprising a transparent first, panel 12 positioned between a second panel 14 and a cover panel 16. The handbag 10 is further comprised of dual side panels 18, one of which is shown in FIG. 1 and FIG. 2, and a bottom surface panel 20 most clearly seen in FIG. 4. In a preferred embodiment, a strap 22 is connected to the side panels 18 to permit facilitated carrying of the handbag 10 described herein. However, any suitable arrangement may be substituted for the strap 22, including a handle. In some cases the bag may have no strap, handle or the like.

As specifically illustrated, the side panels 18 are integral with and extend from the bottom panel 20. The first and second panels 12, 14 are permanently connected thereto, by any suitable means known in the art, along their respective side edges 24*a*, 24*b* and bottom edges 26*a*, 26*b*, to form a receptacle 28 having a primary access opening 30 at the top through which items may be placed and retrieved. In the illustrated and preferred embodiment of FIGS. 1–5, the cover panel 16 and the second panel 14 are permanently connected at upper, opposite corner portions thereof and also joined by a zipper closure means 32 between the corner portions. Upon moving the zipper 32 into an open position, the primary access opening 30 into the receptacle 28 is exposed to enable articles to be inserted and retrieved in the usual manner. The cover panel 16 described herein is dimensioned to completely cover the transparent first panel 12 and is releasably fastened thereto, at least adjacent the bottom edges of the panels by a suitable fastening means 34, such as hook and loop fasteners (e.g., Velcro), magnets, or buttons for example. In the illustrated form of the invention, it is preferable to use hook and loop type fastening means comprising parts 34*a*, 34*b*, wherein fasteners 34*a* are mounted on the transparent first panel 12 and opposing fastening means 34*b* are mounted on the interior, or underside, of the cover panel 16.

As shown in FIGS. 1 and 2, the cover panel 16 is movable relative to the bag structure 10 between a first position, wherein the cover panel 16 is positioned in covering relation to the transparent first panel 12 (FIG. 1) and a second position (FIG. 2), wherein the lower edge of the cover panel 16 is detached from the lower edge of the transparent panel 12, and lifted upward.

The cover panel 16 preferably is secured directly to the second panel 14, or secured thereto by a piece of material or device connecting at least the upper opposite corner portions of the cover panel 16 to the handbag.

As most clearly seen in FIG. 2, the first panel 12 is formed of a transparent, preferably flexible plastic material, whereas the remaining panels of the handbag are formed of any suitable flexible, non-transparent material, including leather, vinyl, and fabric. When the cover panel 16 is in a closed or covering position, the transparent panel 12 and consequently the contents within the bag structure are concealed and may only be retrieved from the handbag 10 through the primary access opening 30, when the zipper closure means 32 is in an open position. When the cover panel 16 is in an open position as shown in FIG. 2, the transparent panel 12 and a secondary access opening 30*a* are exposed, even if the zipper 32 is closed. Accordingly, items contained within the receptacle 28 may be viewed through the transparent panel and may be placed or retrieved through either the primary or secondary access openings 30, 30*a*.

To advantage, an upper edge region of the transparent panel 12 is separably connected to an upper portion of the cover panel 16 by a suitable fastening device 35, typically comprising elements 35*a*, 35*b* of hook and loop materials, magnets, etc. When the cover panel is in its closed position, as shown in FIG. 1, the fastening elements 35*a*, 35*b* are engaged, such that the upper edge of the transparent panel 12 is held closely adjacent to upper portions of the cover panel 16. When the handbag is accessed in a "conventional" manner by opening the zipper 32, the upper edge 13 of the transparent panel 12 is held snugly against the cover panel 16, allowing the user to insert his or her hand downwardly through the primary access opening 30, more or less as if the transparent panel 12 were not there. However, when the cover panel 16 is lifted to the open position, shown in FIG. 2, the fastening elements 34, 35 at the bottom and top edges of the transparent panel are separated, and the contents of the bag are thus available through a the secondary opening 30*a* even though the zipper 32, joining the second panel with the cover panel, may be closed. With the cover panel open, the contents may also be accessed through the primary access opening, if the zipper 32 is open.

As it is understood in the art, flexible piping 36 may be sewn onto the edges of the material surrounding the second and cover panels 14, 16 to enhance the structure and rigidity of the handbag 10.

Typically, the bag structure 10 includes a carrying means, which preferably comprises a shoulder strap 22. The strap 22, is coupled to the bag structure 10 in any manner known in the art. For example, the strap 22, formed of leather, plastic, or other suitably flexible material can be engaged at opposite ends by circular rings 22*a* coupled to the side panels 18 by the appropriate means such as flexible loops 22*b*.

Figure 6:
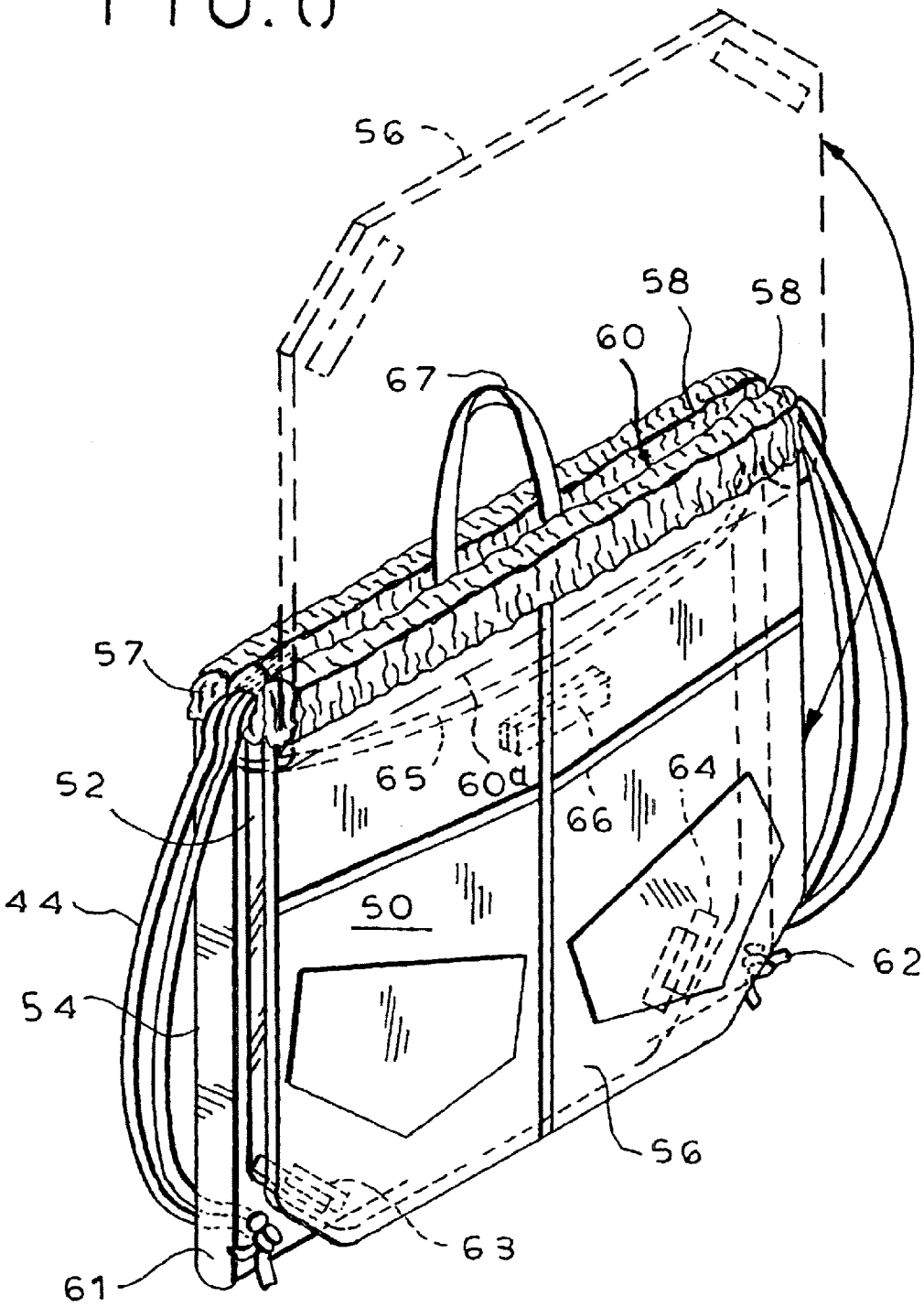
FIG. 6 is a perspective view of an additional embodiment of the invention in which the features of the invention are incorporated into a knapsack.

Referring now to FIG. 6, an alternative embodiment is shown in the form of a knapsack 50. In a preferred construction of the embodiment, a second panel 54 and a cover panel 56 are integrally formed and developed from a single piece of non-transparent material. The material is folded and secured at the uppermost opposing portions, preferably the corners thereof 57, 58. A cut of predetermined length is formed along the upper portion 59 of the unitary piece, forming a primary access opening 60. A transparent first panel 52 is positioned between the second panel 54 and the cover panel 56 and joined to the second panel along side and bottom edges to form an open top receptacle accessible through a secondary access opening 60*a* above a top edge of the transparent panel 52. Desirably, material surrounding the primary access opening 60 is folded and sewn over dual elongated flexible slings 44. The slings 44 are then extended through and secured to the first and second panels 52, 54, adjacent opposite bottom corners 61, 62 thereof, forming convenient over-the-shoulder carrying straps which, when tension is applied thereto, will restrict or close the primary access opening.

To advantage, a carry handle 67 may also be provided at the top of the knapsack 50 as an alternative to carrying the knapsack over the shoulders, using the slings 44.

In the knapsack 50 of FIG. 6, the cover panel 56 is releasably secured to the knapsack and movable between first and second positions generally in the same manner as the cover panel 16 of the first described embodiment. The opposite lower corners of the cover panel 56 are releasably secured to corresponding corner regions of the transparent panel 52 by hook and loop fasteners 63, 64, for example. Likewise, an upper portion of the cover panel 56 is releasably secured to an upper edge portion 65 of the transparent panel 52 by a releasable fastening means 66, such as hook and loop fasteners.

When the cover panel 56 is closed contents of the knapsack can be retrieved only through the primary access opening 60, between upper edge portions of the cover panel 56 and second panel 54, and the contents of the bag are concealed from view except when viewing downward through the primary access opening. When the cover panel 56 is lifted upward, separating the releasable attachments 63, 64 and 66, the entire transparent panel 52 is exposed, including its upper edge 65, so that all of the contents are visible. An object thus may be retrieved through the exposed secondary access opening 60*a*, or through the primary access opening 60, while simultaneously viewing the entire contents of the bag through the transparent panel.

The present invention provides a handbag or the like having at least one wall formed of a transparent panel, which is normally covered by a removable cover panel. The cover panel can be conveniently displaced to facilitate direct viewing and retrieval of objects contained within the storage receptacle. Additionally, the handbag or the like described herein can be manufactured in a variety of designs to accommodate any style.

When the cover panel of the described handbag, knapsack or the like is in its closed or covering position, the bag has the appearance of being an entirely conventional bag, accessible only in the customary way, through its primary access opening by opening a zipper, clasp, draw string or other closure means at the top of the bag to provide both visual and manual access in the conventional manner, only through the top of the bag. When the cover panel is swung away from the transparent panel concealed behind it, the entire contents of the bag are readily visible through the transparent panel, which forms the entire receptacle side wall, while manual access to the contents of the bag is provided through the primary access opening (30, 60) or through a secondary access opening (30*a*, 60*a*) defined in part by the upper edge (13, 65) of the transparent panel. A particular advantage of this arrangement is that the user of the bag may easily see the entire contents thereof from the side of the bag, while reaching in through the primary or top access opening to retrieve a particular object. As will be readily appreciated, this greatly facilitates recovery of a specific item from the typical jumble of miscellaneous items typically found in a handbag.

Another advantageous feature of the invention is that it can significantly expedite security checks, which are becoming more common and, to some extent more thorough, at airports and other public locations. With the handbag or the like of the invention, the cover panel may be lifted away such that the entire contents of the bag made readily visible to the security attendant. The attendant may also easily insert a hand into the bag while continuing to view its contents so as to be confident that the entire contents of the bag have been viewed. By contrast, with a conventional bag, all or a portion of the contents of the bag may have to be removed therefrom in order for the security attendant to have a similar level of confidence that the inspection has been effectively accomplished.

Various modifications to the embodiments described herein will be readily apparent to those skilled in the art. For instance, the cover panel need not be releasably connected directly to the first panel to securely attach the panel over the bag. Rather, the cover panel may be constructed to have a portion thereof extend beyond the first panel to releasably attach to the bottom of the handbag. Additionally, the cover panel may be releasably attached to both the side and bottom panels. As will be readily appreciated the invention may be applied to almost any kind of carry bag, including briefcases, school bags, carry-on luggage, and the like. Likewise, if desired, the bag may have more than one transparent wall, overlaid with one or more cover panels. For example, one or both of the end walls could also be transparent, with one or separate cover panels provided to conceal them. Some of the panels of the carry bag may be formed of rigid material, where desired. For the foregoing reasons, the scope of this invention is to be defined by reference to the appended claims.

What is claimed is:

1. A handbag or the like enabling facilitated viewing and retrieval of contents comprising:

(a) a bag structure having at least first and second panels joined along side and bottom edges to form a receptacle having, an access opening at the top;

(b) said first panel being formed of a flexible transparent material providing visual access, through said first panel, to the contents of the bag;

(c) said transparent first panel having an upper edge;

(d) a cover panel removably positioned in a first position in covering relation to said first panel to block said visual access, said cover panel being at least partially separably attached to said bag structure to enable said cover panel to be displaced from said covering relation to a second position for viewing said contents through said first panel; and (e) panel connecting means separably joining an upper edge region of said flexible transparent panel to an upper portion of said cover panel to facilitate access to said receptacle through said access opening when said cover panel is positioned in said first position.

2. The handbag or the like of claim 1, wherein (a) said access opening at the top comprises a primary access opening;

(b) said flexible transparent panel has an upper edge defining with said second panel a secondary access opening to said receptacle;

(c) said handbag having a top structure defining said primary access opening separate from and above said secondary access opening; and (d) said receptacle being accessible alternatively through said secondary access opening or said primary access opening when said cover panel is in said second position.

3. The handbag or the like of claim 2, wherein said first and second panels have upper edges defining opposite sides of said secondary access opening, the contents of said handbag or the like being retrievable through said primary access opening when said cover panel is in either of said first or second positions, and said contents being viewable through said first panel and retrievable through said secondary access opening when said cover is in said second position.

4. The handbag or the like of claim 1, wherein said first and second panels are joined by being connected to opposing edges of two side panels and a bottom panel.

5. The handbag or the like of claim 4, wherein a carrying means is coupled to said side panels.

6. The handbag or the like of claim 5, wherein said carrying means consists of a strap.

7. The handbag or the like of claim 1, wherein (a) said cover panel is permanently connected at upper opposite corner portions thereof to upper opposite corner portions of said second panel, forming a primary access opening between said panels; and (b) said bag is closeable along the upper edges of said cover panel and said second panel by releasable closure means, said closure means enabling said bag to have open and closed positions, whereby items in said bag may be retrieved or viewed through said primary access opening between said second and cover panels.

8. The handbag or the like of claim 7, wherein said closure means consist of a zipper closure means.

9. The handbag of claim 1, wherein (a) said cover panel is flexibly secured to said second panel in upper portions of said cover panel, (b) lower portions of said cover panel are removably connected to lower portions of said handbag to accommodate upward lifting of said lower portions of said cover panel to provide visual access to the interior of said handbag.

10. The handbag of claim 9, wherein (a) said access opening at the top comprises a primary access opening; and (b) said panel connecting means are detachable to enable said cover panel, when lifted, to be separated from the upper edge region of said transparent first panel, whereby the contents of said bag may be accessed from a secondary opening between the uplifted cover panel and the upper edge of said transparent panel.

11. The handbag of claim 10, wherein (a) upper portions of said cover panel and said second panel are releasably joined to provide said primary access opening to said handbag separate from and above said secondary opening.

12. A handbag or the like enabling facilitated viewing and retrieval of contents comprising:

(a) a bag structure having at least first and second panels, and an access opening at the top;

(b) said first panel being formed of transparent material providing visual access, through said first panel, to the contents of the bag;

(c) a cover panel removably positioned in covering relation to said first panel to block said visual access, said cover panel being at least partially separably attached to said bag structure to enable said cover panel to be displaced from said covering relation for viewing said contents through said first panel;

(d) said first and second panels being connected to opposing edges of two side panels and a bottom panel; and (e) said cover panel being permanently connected at upper opposite corner portions thereof to upper opposite corner portions of said second panel, forming said access opening between said panels.

13. A handbag or the like enabling facilitated viewing and retrieval of contents comprising:

(a) a bag structure having at least first and second panels, and an access opening at the top;

(b) said first panel being formed of transparent material providing visual access, through said first panel, to the contents of the bag;

(c) a cover panel removably positioned in covering relation to said first panel to block said visual access, said cover panel being at least partially separably attached to said bag structure to enable said cover panel to be displaced from said covering relation for viewing said contents through said first panel;

(d) said cover panel and said transparent first panel and said second panel being formed of flexible materials;

(e) said cover panel and said second panel being permanently joined at opposite upper corner areas, and forming said access opening between said last mentioned panels over an extent thereof between said corner areas; and (f) dual slings engaged with upper edges of said cover panel and said second panel, whereby, upon applying tension to said slings, said access opening is constricted to limit access to said contents.

14. The handbag or the like of claim 13, wherein said dual slings are secured at one end thereof to lower corners of said bag, at each side thereof, whereby said handbag or the like may be worn over the shoulders of the user.

* * * * *